United States Patent [19]

Martin

[11] Patent Number: 5,004,353

[45] Date of Patent: Apr. 2, 1991

[54] FLUID MIXING ACCESSORY

[76] Inventor: Jeffrey J. Martin, 1016 North Cavalier, Moore, Okla. 73160

[21] Appl. No.: 438,614

[22] Filed: Nov. 15, 1989

[51] Int. Cl.[5] ..... B01F 15/00

[52] U.S. Cl. ..... 366/349; 141/98; 141/331; 141/337

[58] Field of Search ..... 366/348, 349, 130, 142; 141/331, 337, 343, 98, 369; 422/99; 383/36; 232/43; 222/572

[56] References Cited

U.S. PATENT DOCUMENTS

| | | | |
|---|---|---|---|
| 1,810,806 | 6/1931 | Wilson . | |
| 3,195,752 | 7/1965 | Cox | 141/98 |
| 3,567,033 | 3/1971 | Whelan | 210/497 |
| 4,105,564 | 8/1978 | Whelan | 210/497 R |
| 4,158,631 | 6/1979 | Whelan | 210/497 R |
| 4,230,238 | 10/1980 | Wilson | 141/98 |

*Primary Examiner*—Robert W. Jenkins

*Attorney, Agent, or Firm*—Mary M. Lee

[57] ABSTRACT

A fluid mixing accessory comprising a mixing receptacle integrally formed with a funnel. The accessory is formed of a flexible material which is lightweight and disposable. The measuring receptacle is a graduated cone for measuring the components of a mixture, such as the color, the hardener and the reducer of a paint composition. The funnel has an opening which, depending on the nature of the fluid being mixed, may include a gauze or mesh to act as a strainer. The funnel and the measuring receptacle are joined by a connecting portion. Thus, once the fluid has been mixed in the mixing receptacle, the accessory is inverted so that the mixture runs from the receptacle, across the connecting portion and into the funnel which is positioned over a container. After the funnel has emptied, the entire device then can be collapsed and discarded. The funnel is collapsible for convenient shipping and storage.

21 Claims, 3 Drawing Sheets

FLUID MIXING ACCESSORY

FIELD OF THE INVENTION

The present invention relates generally to mixing containers and strainers, and in particular to devices for mixing and straining paints.

SUMMARY OF THE INVENTION

The present invention comprises a fluid mixing accessory. The accessory comprises a funnel having a mouth and a mixing receptacle having a mouth. A connecting portion is disposed between the mouth of the funnel and the mouth of the mixing receptacle. The funnel, the mixing receptacle and connecting portion are relatively positioned so that fluid contained in the mixing receptacle can be transferred across the connecting portion to the funnel.

DETAILED DESCRIPTION OF THE PREFERRED EMBODIMENTS

In the mixing of spray automotive paints, it is necessary to carefully measure several components, such as color, hardener and reducer. After mixing the paint, the paint is poured immediately into a can which is removably attachable to a power spray apparatus.

Non-disposable measuring cups or mixing containers must be rinsed immediately with solvents, and the used solvent solution is an environmental contaminant. As such, the used solvent must be disposed of in a manner which complies with environmental regulations. By employing the fluid mixing accessory of the present invention, the total time and labor required for a particular paint job is substantially reduced because there is no need to wash mixing and measuring containers.

Furthermore, the problem of proper disposal of large volumes of used solvent solution is eliminated. In a commercial automotive paint operation in which numerous paint applications are made on a daily basis, a large volume of used solvent solution accumulates rapidly. The fluid mixing accessory of the present invention reduces time and labor involved in handling the used solvent solution disposal.

The present invention also provides more economical management of paint components. For example, hardeners are relatively expensive, some costing over one dollar per ounce. The present invention provides a convenient and accurate means for measuring the small amounts of such expensive components, thereby reducing the otherwise unavoidable wastage.

Figure 1:
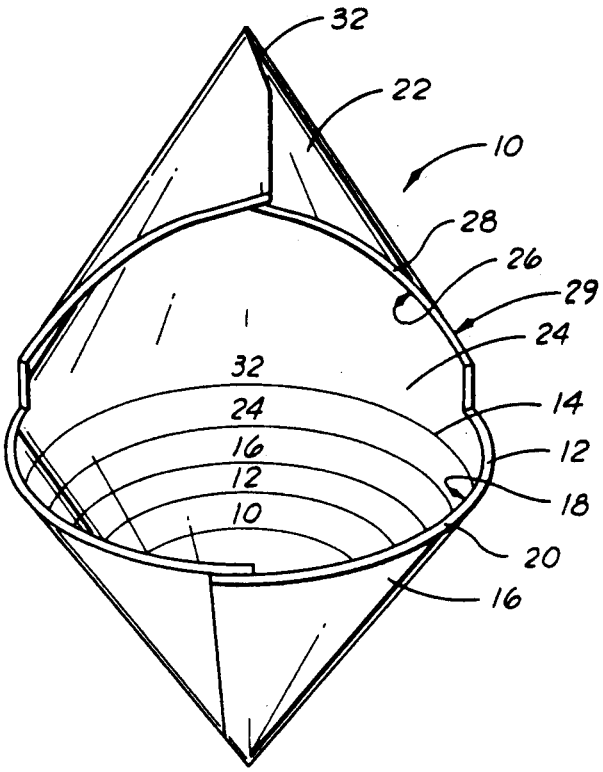
FIG. 1 is a front perspective view of the fully formed fluid mixing accessory.

With reference now to the drawings in general and to FIG. 1 in particular, there is shown therein and designated by the reference numeral 10 a fluid mixing accessory in accordance with the present invention. The accessory 10 comprises a mixing receptacle 12.

Preferably, the receptacle 12 is conical in shape and comprises indicia 14 indicating volumetric amounts. In this way, the receptacle can serve as a measuring cup as well as a mixing receptacle. In the embodiment shown, the indicia indicate ounces with lines representing an increment of one to several ounces. However, depending on the size of the accessory and the accuracy desired, the indicia 14 may indicate ounces or milliliters or both, and may be in single units or in multiple units or a combination. When the fluid mixing accessory is to be used in connection with cooking, it may be desirable to include indicia indicating cups, half cups, quarter cups, and so forth.

The size and shape of the receptacle 12 may vary. The conventional paint spray can holds about 32 ounces of paint. Thus, when employed to mix automotive paints, the receptacle should be sized accordingly. The diameter of the upper portion 16 of the receptacle 12 is sized to rest in the mouth of the can or other container in which the fluid is to be placed, in a manner to be described. A portion of the mouth 18 of the receptacle defines an open upper edge 20.

With continuing reference to FIG. 1, a funnel 22 is attached to the mixing receptacle 12 by a connecting portion 24. The funnel 22 preferably also is conically shaped, and a portion of the mouth 26 of the funnel 22 defines an open upper edge 28. The upper portion 29 of the funnel 22 preferably is sized to rest in the mouth of the can or other container into which the fluid is to be placed, as will be described. The connecting portion 24 extends between the mouth 18 of the receptacle 12 and the mouth 26 of the funnel 22. Thus, the funnel 22 and the receptacle 12 are positioned so that the mouth 26 of the funnel 22 is generally opposed to the mouth 18 of the receptacle 12. Preferably, the mixing receptacle 12, the funnel 22 and the connecting portion 24 are integrally formed.

Figure 2:
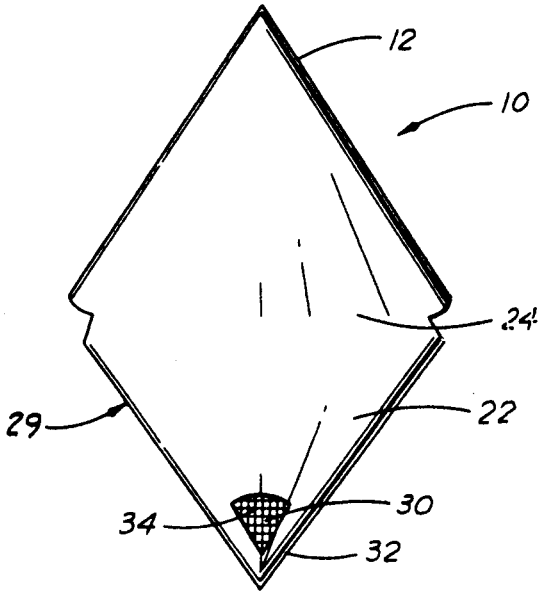
FIG. 2 is a rear elevational view of the fluid mixing accessory shown in FIG. 2.

Turning now to FIG. 2, wherein the accessory 10 is inverted relative to the position in FIG. 1, the funnel 22 has an opening 30 at the bottom end 32 for permitting the fluid to escape. The shape, size, and position of the opening may be varied, and in some instances a plurality of openings may be employed, depending on the fluid to be funneled. As used herein, "fluid" denotes any flowable composition, including liquids and fine particulate matter.

In some instances, such as when metallic paint is being mixed, the opening 30 may be covered with a gauze screen 34 of some suitable material to act as a strainer. The size of the pores in the strainer will be selected according to the type of paint or other fluid being strained.

Figure 3:
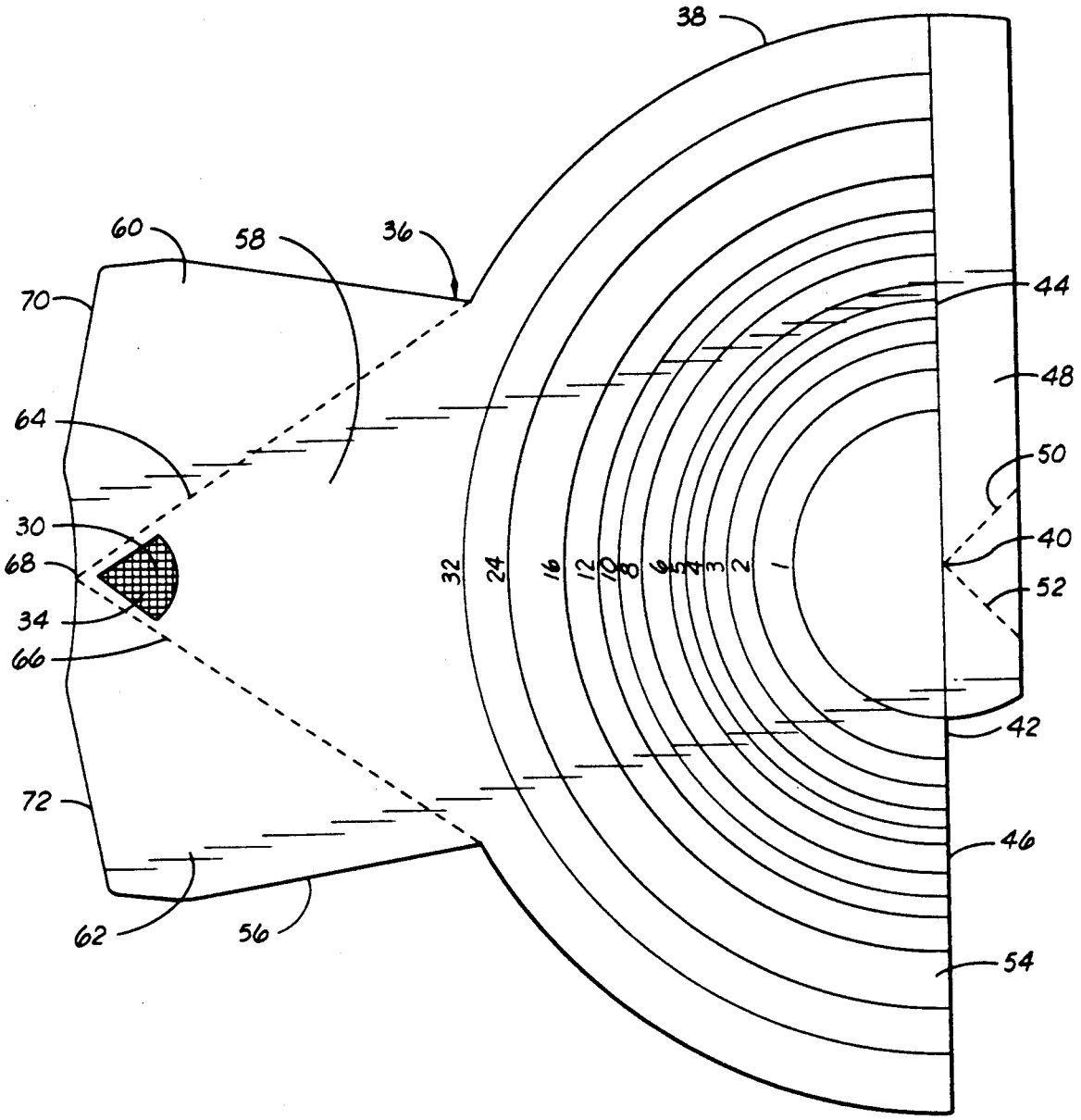
FIG. 3 is a plan view of a blank for constructing the fluid mixing accessory of the present invention.

A one-piece, pre-marked blank 36, from which the fluid mixing accessory 10 of the present invention may be formed, is shown in FIG. 3, to which attention now is directed. The blank 36 preferably is formed of a flexible, light-weight non-absorbent or saturation resistant material, such as 90–100 pound bleached kraft paper, which also is disposable. However, other materials such as translucent plastics may be utilized.

The point on the receptacle portion 38 of the blank 36 which forms the apex of the receptacle 12 is designated by the reference numeral 40. The receptacle portion 38 has an edge 42, which when bisected, forms a first half 44 and a second half 46, and which when folded onto itself, forms the receptacle portion 38 into the conical receptacle 12. A flap 48 extends from the first half 44 and part of the second half 46.

Broken lines 50 and 52 indicate crease lines along which the flap 48 is folded. The crease 50 is folded outwardly, that is, below the plane of the blank 36. The crease 52 is folded inwardly, that is, above the plane of the blank 36. The flap 48 then is brought around and positioned over the outside of the approximate border, designated generally at 54, of the receptacle portion 38 by a glue which is insoluble in the fluid to be mixed therein. It will be understood that the flap 48 is positioned so that the first half 44 of the edge 42 meets precisely the second half 46. In this way, the lines of the indicia 14 will meet forming circles on the inside of the receptacle 12, as shown in FIG. 1.

Referring still to FIG. 3, the funnel portion 56 of the blank 36 extends from the receptacle portion 38. The funnel portion 56 is divided into a rear wall 58 and a first side 60 and a second side 62. The broken lines 64 and 66 indicate crease lines separating the sides 60 and 62 from the rear wall 68. The point 68 designates the apex of the formed funnel, and the opening 30 with the gauze strainer 34 is positioned near the apex 68. The first and second sides 60 and 62 have free edges 70 and 72, respectively. The funnel 22 (FIGS. 1 and 2) is formed by bringing the edges 70 and 72 together in overlapping fashion and gluing them together with a glue that is insoluble to the fluid to be poured therethrough.

When formed in this manner, the funnel 22 in the completely formed accessory 10 can be collapsed, while the mixing receptacle 12 remains in its conical shape. This is ideal for shipping and storage. Moreover, it is useful during the mixing operation, as will be explained more fully hereafter.

Figure 4:
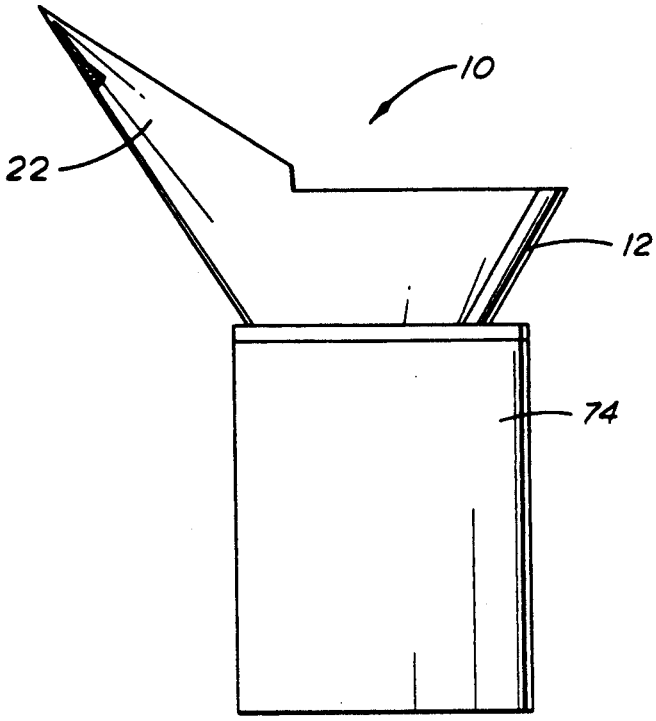
FIG. 4 is a side elevational view of the fluid mixing accessory with the measuring cone positioned in the mouth of a fluid container.
Figure 5:
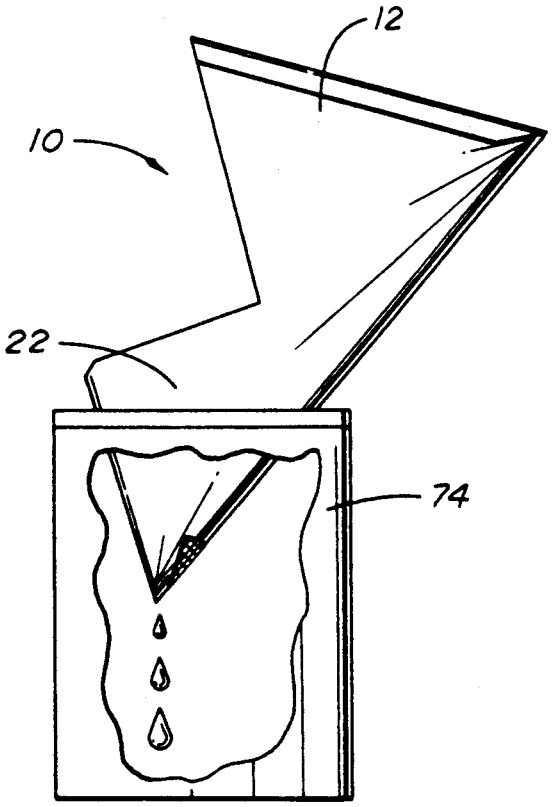
FIG. 5 is a side elevational view of the fluid mixing container with the strainer positioned in the mouth of the fluid container.

Turning now to FIG. 4, there is shown therein the accessory 10, with the funnel 22 collapsed and the mixing receptacle 12 positioned in a container, such as a typical spray paint can 74. With the accessory 10 in this position, the components of the fluid to be mixed are measured and combined in the mixing receptacle 12. With the funnel 22 collapsed, the mouth 18 of the mixing receptacle 12 is fully accessible. Also, the collapsed funnel 22 serves as a convenient handle for positioning and steadying the mixing receptacle 12, as necessary, during the measuring and mixing process.

Having sufficiently mixed the fluid, the funnel 22 of the accessory 10 then is opened, the accesory 10 is inverted gently, and the funnel 22 is positioned in the can 74. It will be understood that the fluid flows from the mixing receptacle 12 across the connecting portion 24 and into the funnel 22 by gravity. From here, the fluid flows into the can 74 cleanly and quickly. When the funnel 22 is empty, the accessory 10 is discarded, no rinsing or other cleaning of any kind being required.

Now it will be apparent that the fluid mixing accessory of the present invention greatly facilitates the mixing of measured components of a fluid and the transfer of that fluid into a selected container. More particularly, the fluid mixing accessory of the present invention makes automotive painting operations more convenient and economical.

Changes may be made in the combination and arrangement of the various parts, elements, steps and procedures described herein without departing from the spirit and scope of the invention as defined in the following claims.

What is claimed is:

1. A fluid mixing accessory comprising:

a funnel having a mouth and a bottom;

a mixing receptacle having a mouth and a bottom;

a connecting portion between the mouth of the funnel and the mouth of the mixing receptacle; and wherein the funnel, the mixing receptacle and connecting portion are relatively disposed so that fluid contained in the mixing receptacle can be transferred across the connecting portion to the funnel; and wherein the diameter of the funnel and mixing receptacle gradually diminishes from the mouth to the bottom.

2. The fluid mixing accessory of claim 1 wherein the funnel comprises a strainer.

3. The fluid mixing accessory of claim 2 wherein the mixing receptacle comprises measuring indicia.

4. The fluid mixing accessory of claim 3 wherein the funnel, the mixing receptacle and the connecting portion are integrally formed.

5. The fluid mixing accessory of claim 4 wherein the funnel is collapsible.

6. The fluid mixing accessory of claim 5 wherein the fluid mixing accessory is disposable.

7. The fluid mixing accessory of claim 1 wherein the mixing receptacle comprises measuring indicia.

8. The fluid mixing accessory of claim 7 wherein the funnel, the mixing receptacle and the connecting portion are integrally formed.

9. The fluid mixing accessory of claim 8 wherein the funnel is collapsible.

10. The fluid mixing accessory of claim 9 wherein the fluid mixing accessory is disposable.

11. The fluid mixing accessory of claim 1 wherein the funnel, the mixing receptacle and the connecting portion are integrally formed.

12. The fluid mixing accessory of claim 11 wherein the funnel is collapsible.

13. The fluid mixing accessory of claim 12 wherein the fluid mixing accessory is disposable.

14. The fluid mixing accessory of claim 1 wherein the funnel is collapsible.

15. The fluid mixing accessory of claim 14 wherein the fluid mixing accessory is disposable.

16. The fluid mixing accessory of claim 1 wherein the fluid mixing accessory is disposable.

17. The fluid mixing accessory of claim 1 wherein the funnel comprises a strainer; wherein the funnel, the mixing receptacle and the connecting portion are integrally formed; wherein the funnel is collapsible; and wherein the fluid mixing accessory is disposable.

18. The fluid mixing accessory of claim 1 wherein the funnel comprises a strainer; wherein the mixing receptacle comprises measuring indicia; wherein the funnel is collapsible; and wherein the fluid mixing accessory is disposable.

19. The fluid mixing accessory of claim 1 wherein the funnel comprises a strainer; wherein the mixing receptacle comprises measuring indicia; wherein the funnel, the mixing receptacle and the connecting portion are integrally formed; and wherein the funnel is collapsible.

20. The fluid mixing accessory of claim 1 wherein the funnel comprises a strainer; wherein the mixing receptacle comprises measuring indicia; wherein the funnel, the mixing receptacle and the connecting portion are integrally formed; and wherein the fluid mixing accessory is disposable.

21. The fluid mixing accessory of claim 1 wherein the funnel and the mixing receptacle are conically shaped.

* * * * *